US007575123B2

(12) United States Patent
Laveault et al.

(10) Patent No.: US 7,575,123 B2
(45) Date of Patent: Aug. 18, 2009

(54) TAMPER-EVIDENT LOCKING BAND FOR A CONTAINER CLOSURE

(75) Inventors: Richard A. Laveault, Ft. Wayne, IN (US); Rowshan Jahan, Ft. Wayne, IN (US)

(73) Assignee: Rieke Corporation, Auburn, IN (US)

( * ) Notice: Subject to any disclaimer, the term of this patent is extended or adjusted under 35 U.S.C. 154(b) by 919 days.

(21) Appl. No.: 11/038,868

(22) Filed: Jan. 19, 2005

(65) Prior Publication Data

US 2006/0163189 A1 Jul. 27, 2006

(51) Int. Cl.

| | |
|---|---|
| ***B65D 53/00*** | (2006.01) |
| ***B65D 55/02*** | (2006.01) |
| ***B65D 39/00*** | (2006.01) |
| ***B65D 41/00*** | (2006.01) |
| ***B65D 43/00*** | (2006.01) |
| ***B65D 51/00*** | (2006.01) |
| *B65D 47/00* | (2006.01) |

(52) U.S. Cl. ..... 220/214; 215/252; 215/343

(58) Field of Classification Search ..... 215/252, 215/258, 330, 334, 387, 901; 220/259.3, 220/259.4

See application file for complete search history.

(56) References Cited

U.S. PATENT DOCUMENTS

| | | | | |
|---|---|---|---|---|
| 4,878,589 A | | 11/1989 | Webster et al. | 215/252 |
| 4,904,435 A | | 2/1990 | Babcock et al. | 264/154 |
| 4,913,300 A | | 4/1990 | Wiedmer et al. | 215/252 |
| 4,938,370 A | | 7/1990 | McBride | |
| 4,984,701 A | | 1/1991 | Margaria | 215/256 |
| 4,997,097 A | | 3/1991 | Krautkrämer | 215/307 |
| 5,050,753 A | * | 9/1991 | Trump et al. | 215/252 |
| 5,131,550 A | | 7/1992 | Thompson | 215/252 |
| 5,167,335 A | | 12/1992 | McBride et al. | 215/252 |
| 5,205,426 A | | 4/1993 | McBride et al. | |

(Continued)

FOREIGN PATENT DOCUMENTS

EP 0 381 118 A1 8/1990

(Continued)

OTHER PUBLICATIONS

Printouts from website of Alcoa Closure Systems International, Inc. (Alcoa CSI). Indianapolis, Indiana (www.alcoacsi.com) printed Nov. 22, 2003, 15 pgs. total.

*Primary Examiner*—Anthony D Stashick
*Assistant Examiner*—Madison L Wright
(74) *Attorney, Agent, or Firm*—Woodard, Emhardt, Moriarty, McNett & Henry LLP

(57) ABSTRACT

A container and closure combination according to one embodiment of the present invention includes, as part of the closure, a tamper-evident band. The container includes a neck portion defining a dispensing opening and including an A diameter stop. The tamper-evident closure includes a closure body and the tamper-evident band is connected to the closure body by a plurality of frangible elements. A plurality of locking tabs are included as part of the tamper-evident band and are constructed and arranged to abut up against the A diameter stop upon retrograde rotation of the closure body from the container neck. The tamper-evident band further includes a radially inwardly extending ridge that is constructed and arranged to prevent repositioning of a plurality of the locking tabs to an orientation wherein the plurality of locking tabs would avoid abutment with the A diameter stop.

36 Claims, 5 Drawing Sheets

U.S. PATENT DOCUMENTS

| | | | | | |
|---|---|---|---|---|---|
| 5,356,020 | A | | 10/1994 | Thompson | 215/252 |
| 5,423,444 | A | | 6/1995 | Druitt | 215/344 |
| 5,501,349 | A | * | 3/1996 | McCandless | 215/252 |
| 5,547,092 | A | | 8/1996 | Thompson | 215/252 |
| 5,676,269 | A | * | 10/1997 | Blake et al. | 215/252 |
| 5,891,380 | A | | 4/1999 | Larue et al. | 264/296 |
| 6,085,921 | A | * | 7/2000 | Brown | 215/252 |
| 6,123,212 | A | * | 9/2000 | Russell et al. | 215/330 |
| 6,126,027 | A | | 10/2000 | Thompson | 215/354 |
| 6,202,872 | B1 | * | 3/2001 | Smeyak et al. | 215/343 |
| 6,325,225 | B1 | | 12/2001 | Druitt et al. | 215/252 |
| 6,382,445 | B1 | | 5/2002 | McCandless | 215/341 |
| 6,557,714 | B2 | | 5/2003 | Babcock et al. | 215/252 |
| 6,769,559 | B2 | * | 8/2004 | Ziegler et al. | 215/349 |
| 2002/0030031 | A1 | | 3/2002 | Druitt et al. | 215/252 |
| 2002/0096485 | A1 | * | 7/2002 | Zumbuhl | 215/252 |
| 2004/0232100 | A1 | | 11/2004 | Reidenbach | |

FOREIGN PATENT DOCUMENTS

| | | | |
|---|---|---|---|
| EP | 0 508 396 | A1 | 10/1992 |
| EP | 0 854 095 | A1 | 7/1998 |
| EP | 0 856 474 | A1 | 8/1998 |
| EP | 0 650 444 | B2 | 12/2002 |
| WO | WO 92/22464 | | 12/1992 |

* cited by examiner

TAMPER-EVIDENT LOCKING BAND FOR A CONTAINER CLOSURE

BACKGROUND OF THE INVENTION

The present invention relates generally to the design of tamper-evident bands that form a part of a closure for a container. More specifically, the present invention relates to the addition of an annular ridge to a lower portion of a tamper-evident band in order to enhance or improve the ability of the band to prevent any tampering attempt without a suitable indication of that attempt being provided. As the name implies, a "tamper-evident" band is constructed and arranged to make it evident to a user or consumer if tampering with the container or its contents has been attempted. The value of such a band is directly related to how well it performs and how successfully it reveals or prevents any tampering attempts.

One example of tamper-evident bands that are currently in use can be found on metal caps for carbonated beverages. The tamper-evident band is connected to the remainder of the cap by a spaced series of connecting leaders or what are called frangible elements. The container includes an annular stop, referred to as the "A" diameter, at the base of the neck, and the tamper-evident band is anchored below this "A" diameter stop by a series of projections, referred to as wings or tabs. The problem that the present invention solves pertains to those tamper-evident band designs that are constructed so as to permit a small implement or tool to be inserted between the tamper-evident band and the container neck in order to pull down the securing tabs. If these tabs are pulled down and out of the way such that they do not engage the "A" diameter stop upon removal of the cap, undetected tampering attempts are possible. In order for these tabs to be pulled out of the way a sufficient distance and into a sufficient orientation in order to clear the "A" diameter, they need to be pulled down to a near vertical position.

The annular ridge of the present invention is directed to reducing the risk that the referenced small implement or tool might be inserted by reducing the radial width of the clearance space between the lower edge of the tamper-evident band and the container neck. While the annular ridge of the present invention reduces the radial width of the clearance space, it may still be possible for an individual to insert some type of tool or instrument into that reduced clearance space to try and pull down the tabs. Therefore, the primary purpose of the annular ridge is to provide an abutment surface. The annular ridge of the present invention has an axial and radial position, a geometric shape, and an inclined upper surface that serves as an abutment cooperating together so that the tabs cannot be pulled down far enough to preclude abutment with the "A" diameter. Even if it would be possible to design the annular ridge of the present invention to achieve only one of the two improvements as described, the preferred design for the present invention is to be able to achieve both improvements by a single ridge configuration, as disclosed herein as the present invention.

SUMMARY OF THE INVENTION

A tamper-evident closure for a container according to one typical embodiment of the present invention includes a closure body and a tamper-evident band connected to the closure body by a plurality of frangible elements. The tamper-evident band includes a plurality of locking tabs that are constructed and arranged to abut against a portion of the container, the tamper-evident band further including a radially inwardly extending ridge constructed and arranged to prevent repositioning of a plurality of the locking tabs to an orientation wherein the plurality of locking tabs avoid abutment with the portion of the container.

One object of the present invention is to provide an improved tamper-evident closure for a container.

Related objects and advantages of the present invention will be apparent from the following description.

DESCRIPTION OF THE PREFERRED EMBODIMENTS

Figure 1:
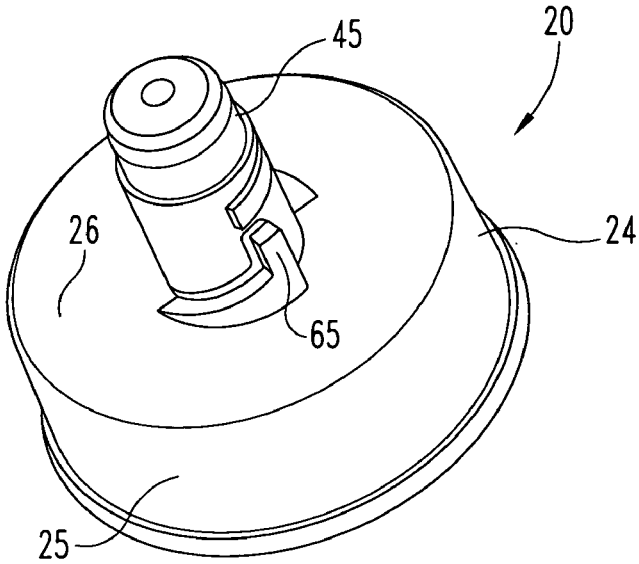
FIG. 1 is a perspective view of a closure according to one embodiment of the present invention.
Figure 2:
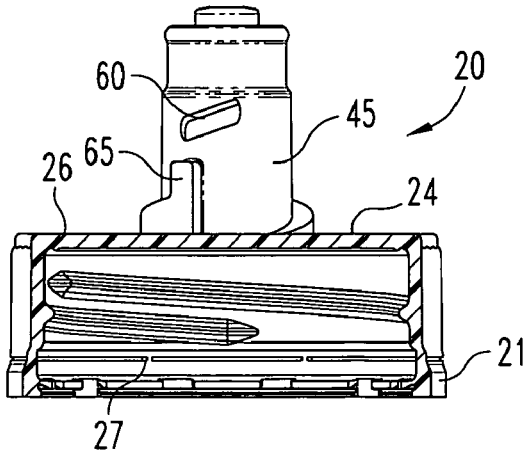
FIG. 2 is a front elevational view, in partial section, of the FIG. 1 closure.
Figure 3:
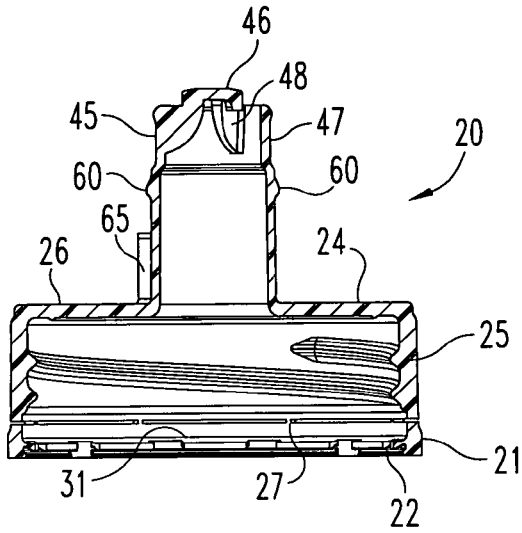
FIG. 3 is a front elevational view, in full section, of the FIG. 1 closure.
Figure 4:
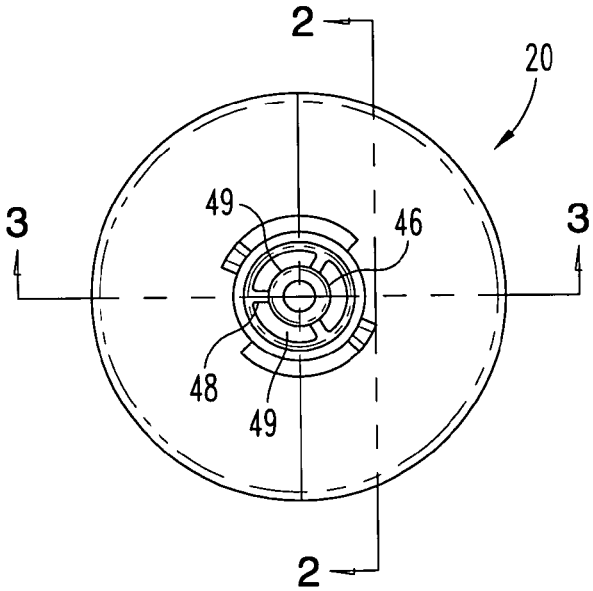
FIG. 4 is a top plan view of the FIG. 1 closure.
Figure 5:
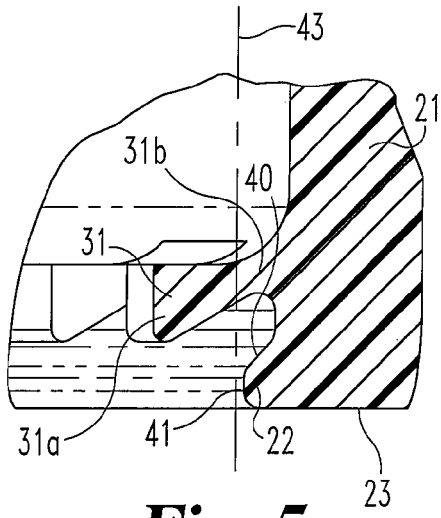
FIG. 5 is a partial, enlarged detail, front elevational view of a portion of the FIG. 1 closure, in full section.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 7:
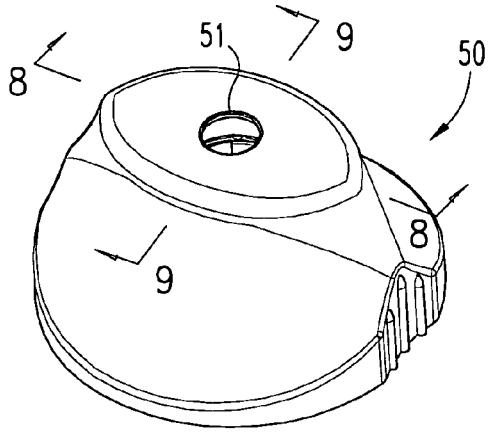
FIG. 7 is a perspective view of a twist cap that cooperates with the FIG. 1 closure to open and close the FIG. 1 closure.
Figure 8:
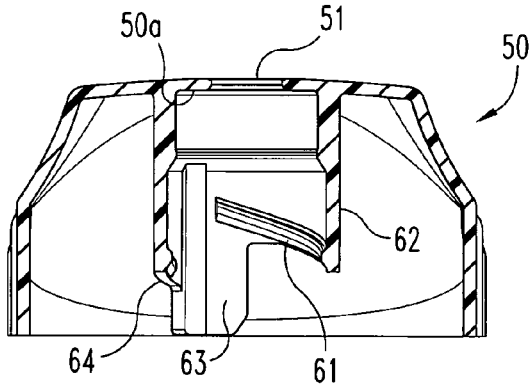
FIG. 8 is a front elevational view, in full section, of the FIG. 7 cap as viewed along line 8-8 in FIG. 7.
Figure 9:
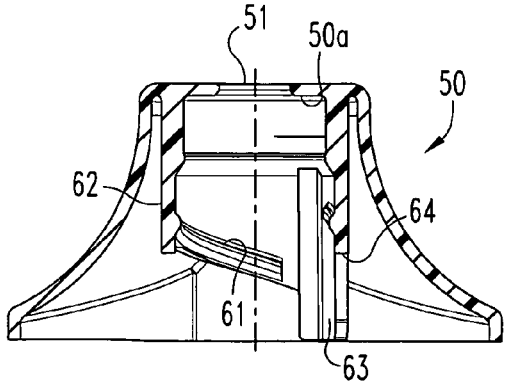
FIG. 9 is a side elevational view, in full section, of the FIG. 7 cap as viewed along line 9-9 in FIG. 7.

Referring to FIGS. 1-5, there is illustrated a closure 20 for a container that includes a tamper-evident band 21 with, in one embodiment, an annular ridge 22 that extends radially inwardly from the lower edge 23 of band 21. In an alternate embodiment of the present invention, what is described as an annular ridge 22 is actually formed in spaced-apart segments. While these segments extend annularly around the lower edge 23 of band 21, the length of each ridge section and the spacing between adjacent ridge sections can vary. With continued reference to FIG. 1 and the illustrated embodiment of the present invention where the ridge 22 is annular and continuous in form, closure 20 includes an internally-threaded body 24 including a side wall 25 and an upper wall 26. The side wall 25 is connected to the tamper-evident band 21 by a series of frangible elements 27. Closure 20 is constructed and arranged as part of a twist-to-open closure assembly. As will be described herein, a twist cap 50 (see FIGS. 7, 8, and 9) snaps onto closure 20 and is turned so as to cam up to open and cams down to close the closure assembly.

Figure 6:
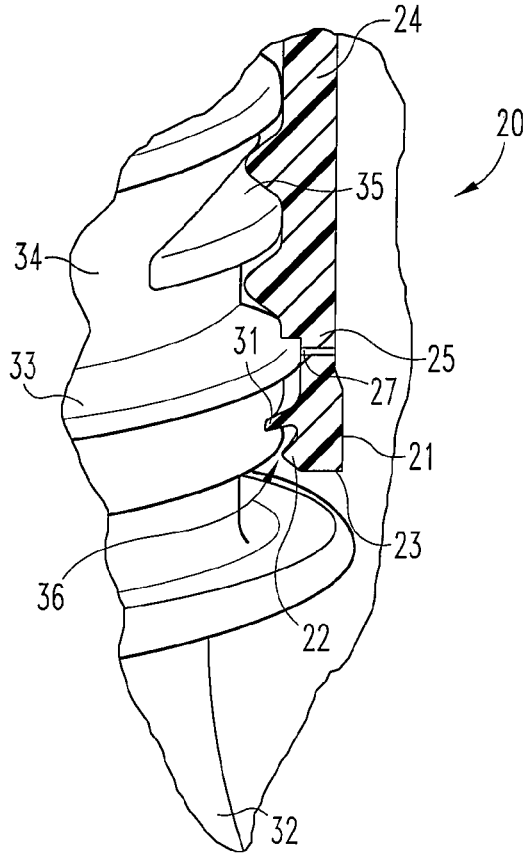
FIG. 6 is a partial, front elevational view, in full section, of the FIG. 1 closure installed on the neck finish of a container.

The tamper-evident band 21 is formed with a series of tabs 31 that extend radially inwardly and are intended to provide abutment and locking for the tamper-evident band. The tabs 31 are positioned below the frangible elements 27 and above annular ridge 22. Each tab 31 includes an inner enlarged portion 31*a* and a reduced axial thickness section 31*b* located between portion 31*a* and the remainder of band 21. Each section 31*b* is constructed and arranged as a deflection location for the corresponding tab 31. When the closure 20 is initially threadedly advanced onto the container 32 for closing of the container immediately after filling, as part of the capping operation, the tabs 31 are ultimately positioned below the "A" diameter stop 33 (see FIG. 6) that is formed as a part of the container neck 34 at the bottom of the external threads 35. As the closure is advanced, the tabs 31 deflect upwardly as they are forced to pass over the annular stop 33. Once the tabs are below the stop 33, the stop 33 serves as an abutment to the tabs 31 when the closure 20 is unscrewed from the neck 34 of the container 32 for the first time after the capping operation.

Until the frangible elements 27 are broken, the tamper-evident band 21 remains connected to the remainder of closure 20, specifically to body 24 and side wall 25. When the closure 20 is to be removed from the container neck, it is unscrewed from the externally-threaded neck 34 of the container 32 and moves in an axially upward direction. This retrograde movement causes the tabs 31 to be drawn up or pulled up into abutment against the undersurface of the annular stop 33. As this abutment occurs, the axial movement of the tamper-evident band 21 stops. As the twisting, i.e., unscrewing, of the body 24 continues, the frangible elements 27 begin to break or fracture due to both twisting and axial movement of the cap relative to the neck and relative to the tamper-evident band 21 that is unable to move axially due to the abutment of the plurality of tabs 31 against the "A" diameter stop 33. Once all the frangible elements 27 are broken or severed, the body 24 of the closure 20 is separated from the tamper-evident band 21. The tamper-evident band 21 remains on the container 32, fixed below the "A" diameter stop 33. The body 24 of the closure 20 is thus able to be repeatedly removed and reapplied, as often as one wishes, in order to open and close container 32.

Without the presence of annular ridge 22, it is possible that a small tool or implement can be inserted into the annular clearance space 36 between the inside diameter of the band 21 and the outside diameter of the neck 34 of container 32. If this occurs, that small tool or implement can be manipulated to hook over and pull down each tab 31, one at a time. With a plastic construction for closure 20, using one of the suitable synthetic materials, it is likely that each tab 31 will remain in the new position to where it is moved, such as being pulled downwardly so that each tab has a new axial or vertical orientation. In this vertical position, or whenever the tabs 31 are pulled out of the way, they are unable to engage stop 33 and therefore do not abut up against the lower surface of stop 33. In this near axial or vertical orientation for the various tabs 31, they will actually clear stop 33 during unthreading or removal of the closure 20 from container 32. Without any abutment of the tabs 31 against the stop 33, there is nothing to cause or create separation of the tamper-evident band 21 from the body or remainder of the closure. This means that someone, after all the tabs are pulled down to a position in order to clear the stop 33, could remove the closure from the neck of the container without any indication that this has occurred. If tampering occurs while the closure is removed and then reapplied, there is nothing structurally to provide an indication or evidence of such a tampering attempt. This is where the value of the present invention in the form of annular ridge 22 will be appreciated.

Focusing now on the construction and arrangement of annular ridge 22, it is preferred that ridge 22 have an angled or tapered upper surface 40, inclined axially downwardly and radially inwardly. It is also preferred that innermost tip 41 be sized so as to just clear the outer surface, i.e., the outside diameter, of "A" diameter stop 33. This outside diameter is represented by line 43 in FIG. 5. In this way, there is no noticeable interference between the stop 33 and ridge 22 during the initial capping operation of the container 32 by closure 20, after initial filling. The radial width of clearance space 36 is reduced by the addition of ridge 22 and reduced to such a degree that it becomes more difficult for someone to be able to insert a tool or implement into that clearance space 36 in order to hook onto and pull down one or more of the various tabs 31. While the radial width of clearance space 36 could be reduced even more by increasing the radial width of ridge 22, that change would create what is considered to be an unacceptable degree of interference with stop 33 and would therefore adversely affect the initial capping operation.

A second aspect of the present invention involves the design of the inclined upper surface 40. This aspect is effective in defeating any tampering attempt by one who tries to pull down the tabs 31 so that the closure could be removed without breaking any of the frangible elements 27. Even if there is sufficient clearance for a person intent on trying to insert a tool to be able to do so, the tabs 31 still abut against the upper surface 40 of ridge 22 before the tabs 31 are pulled sufficiently out of the way so that those tabs would clear stop 33. Due to ridge 22 and the construction of its upper surface 40, the tabs cannot be pulled down sufficiently close to a vertical orientation in order to clear stop 33. In effect, the upper surface 40 serves as an abutment surface, limiting the downward travel for tabs 31. While ridge 22 can be a continuous annular form, it can also be segmented and, if segmented, it is preferable to have a segment in alignment with each tab so as to provide the described abutment. With ridge 22 present, even if a tool is inserted and even if the tabs 31 are pulled down, the tabs cannot be pulled down a sufficient degree due to the abutment against surface 40, and this effectively causes the tabs to abut up against stop 33 during any removal attempt of closure 20 from container 32. With this abutment of the tabs 31 against stop 33, and if there is a continued retrograde turning of the closure off of the container neck, this will cause the frangible elements 27 to break and thus there will be an indication of any tampering attempt.

While the preferred construction for closure 20 is as a unitary, molded plastic component, the present invention involving the addition of annular ridge 22 is equally applicable to metal closures as well as plastic and can be incorporated into a metal closure with a plastic liner. The present invention can be included as part of twist-to-open or close closure designs similar to what is illustrated in FIGS. 1-9 or as part of a more simplistic closure structure, such as that illustrated in FIGS. 10 and 11.

Referring to FIGS. 1-9, closure 20 has a twist-to-open design based on a cam action involving a spiral tract. Dispensing spout 45 is hollow and opens into the neck opening of whatever container is used and to which closure 20 is threadedly assembled, such as container 32. Cylindrical top 46 is connected to cylindrical wall 47 by three triangular, webbed spokes 48. The openings 49 between adjacent spokes 48 provide the flow paths for the contents of the container 32 to be dispensed. The twist-to-open and twist-to-close design of spout 45 works in cooperation with movable twist cap 50 (see FIGS. 7, 8 and 9). Cap 50 is constructed and arranged to snap onto closure 20 and to be connected thereto.

In the closed condition, tip 46 fits closely into opening 51 such that openings 49 are closed off by the upper inner surface 50*a* of cap 50. With counter clockwise twisting of cap 50 of approximately 100 degrees, cap 50 moves axially upwardly away from closure 20 by means of a camming action involving movement of a raised portion within a receiving channel. This axial movement causes opening 51 to separate axially from tip 46. This in turn results in uncovering openings 49 and creating dispensing paths for the contents of the container. With the closure assembly (closure 20 and cap 50) in the open condition, inverting or tilting the container 32 enables the contents, or at least some portion of the contents, to be dispensed by pouring or assisted by squeezing the sides of the container.

To close the closure assembly, the cap 50 is turned approximately 100 degrees in a clockwise direction and the cap 50 cams downwardly in the direction of closure 20. This action brings cap 50 axially downward to close off the openings 49 as the tip 46 fits snugly into and against opening 51.

The described camming action involves the interfit of raised segments 60 on the dispensing spout 45 and cooperating channels 61 formed in the inner sleeve 62 of cap 50. The axially depending tabs 63 that are integral with the lower edge 64 of sleeve 62 abut up against opposing stops 65 so as to limit the clockwise and counter clockwise travel of the cap 50 relative to closure 20.

Figure 10:
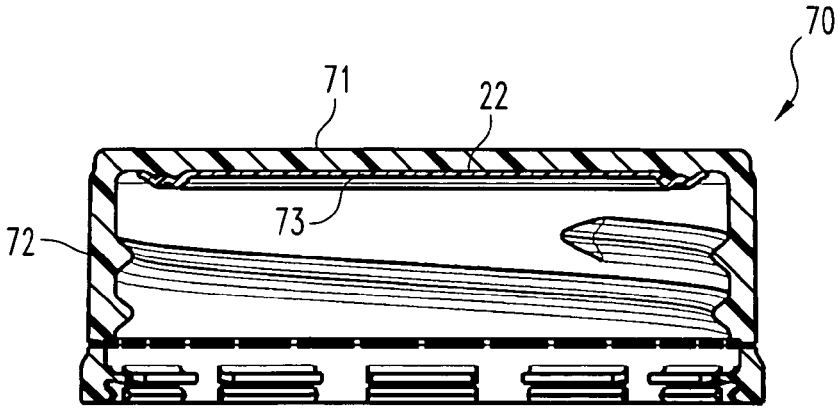
FIG. 10 is a front elevational view, in full section, of an alternative cap design, according to the present invention and incorporating features of the FIG. 1 closure.
Figure 11:
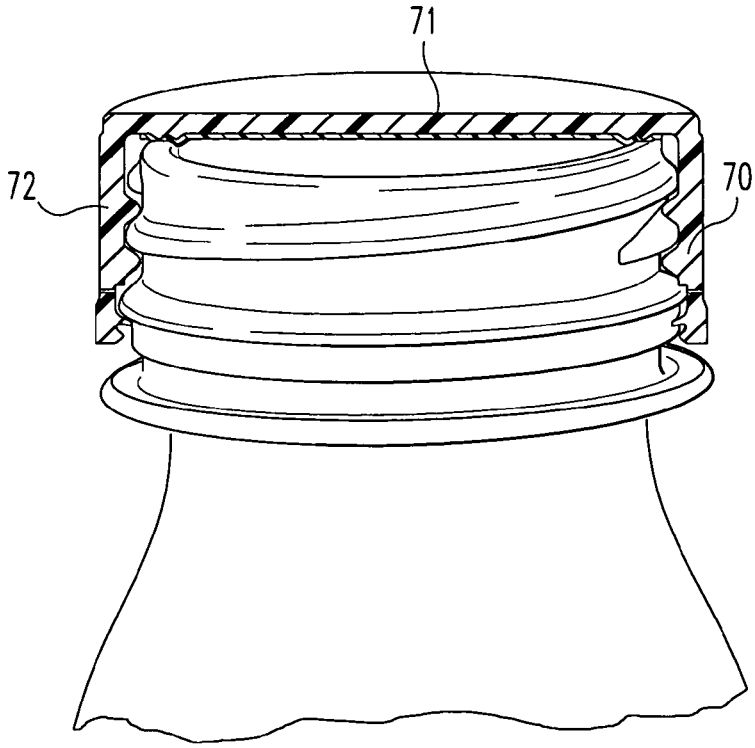
FIG. 11 is a front elevational view, in partial section, of the FIG. 10 cap as applied to the neck finish of a container.

Referring to FIGS. 10 and 11, closure 70 is a conventional flat top 71, cylindrical side wall 72 closure that is internally threaded for closing the neck opening of a container (see FIG. 11). Closure 70 includes a unique liner 73 with a wave portion for securely sealing the closure-to-container interface whether the container is subjected to a hot fill process, an aseptic fill process, or a nitrogen fill process. Closure 70 is the subject of another commonly-owned, co-pending patent application filed on the same date as this application. The patent application is Ser. No. 11/039,151. This co-pending application is expressly incorporated by reference herein for its entire teachings. Whether this style of closure is used with the present invention or whether closure 20 is used, the construction and arrangement of tamper-evident band 21 remains the same, the design of the locking tabs 31 remains the same, the frangible elements 27 remain the same, and the annular ridge 22 of the present invention remains the same.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A tamper-evident closure for a container having an A diameter stop, said tamper-evident closure comprising:

a closure body; and a tamper-evident band connected to said closure body by a plurality of frangible elements, said tamper-evident band including a plurality of locking tabs constructed and arranged to abut against said A diameter stop during initial removal of said closure from said container, each locking tab being constructed and arranged with a radially-inward first portion having a free end and an intermediate second portion located between said first portion and the remainder of said tamper-evident band, said first portion being enlarged relative to said second portion and said second portion having a reduced axial thickness relative to said first portion, said tamper-evident band further including a radially inwardly extending ridge that is constructed and arranged to prevent repositioning of a plurality of said locking tabs to an orientation wherein said plurality of locking tabs avoid abutment with said A diameter stop.

2. The tamper-evident closure of claim 1 wherein said ridge is arranged into a plurality of spaced-apart sections.

3. The tamper-evident closure of claim 2 wherein each section of said ridge includes an inclined upper surface.

4. The tamper-evident closure of claim 3 wherein said locking tabs are positioned axially between said frangible elements and said ridge.

5. The tamper-evident closure of claim 4 wherein said closure body is internally threaded.

6. The tamper-evident closure of claim 1 wherein said ridge is constructed and arranged as an annular member.

7. The tamper-evident closure of claim 6 wherein said ridge includes an inclined upper surface facing said plurality of locking tabs.

8. The tamper-evident closure of claim 7 wherein said locking tabs are positioned axially between said frangible elements and said ridge.

9. The tamper-evident closure of claim 8 wherein said closure body is internally threaded.

10. In combination:

a container having a neck portion defining a dispensing opening and an A diameter stop; and a tamper-evident closure for said container, said tamper-evident closure comprising:

a closure body; and a tamper-evident band connected to said closure body by a plurality of frangible elements, said tamper-evident band including a plurality of locking tabs constructed and arranged to abut against said A diameter stop during initial removal of said closure from said container, each locking tab being constructed and arranged with a radially-inward first portion having a free end and an intermediate second portion located between said first portion and the remainder of said tamper-evident band, said first portion being enlarged relative to said second portion and said second portion having a reduced axial thickness relative to said first portion, said tamper-evident band further including a radially inwardly extending ridge that is constructed and arranged to prevent repositioning of a plurality of said locking tabs to an orientation wherein said plurality of locking tabs avoid abutment with said A diameter stop.

11. The combination of claim 10 wherein said ridge is arranged into a plurality of spaced-apart sections.

12. The combination of claim 11 wherein each section of said ridge includes an inclined upper surface.

13. The combination of claim 12 wherein said locking tabs are positioned axially between said frangible elements and said ridge.

14. The combination of claim 13 wherein said closure body is internally threaded.

15. The combination of claim 10 wherein said ridge is constructed and arranged as an annular member.

16. The combination of claim 15 wherein said ridge includes an inclined upper surface facing said plurality of locking tabs.

17. The combination of claim 16 wherein said locking tabs are positioned axially between said frangible elements and said ridge.

18. The combination of claim 17 wherein said closure body is internally threaded.

19. A tamper-evident closure for a container having an A diameter stop, said tamper-evident closure comprising:

a closure body; and a tamper-evident band connected to said closure body by a plurality of frangible elements, said tamper-evident band including a plurality of locking tabs constructed and arranged to abut said A diameter stop during initial removal of said closure from said container, each locking tab being constructed and arranged with a radially-inward first portion having a free end and an intermediate second portion located between said first portion and the remainder of said tamper-evident band, said first portion being enlarged relative to said second portion and said second portion having a reduced axial thickness relative to said first portion, said tamper-evident band further including a radially inwardly extending ridge that is constructed and arranged to prevent repositioning of a plurality of said locking tabs to a substantially vertical orientation wherein said plurality of locking tabs avoid abutment with said A diameter stop.

20. The tamper-evident closure of claim 19 wherein said ridge is arranged into a plurality of spaced-apart sections.

21. The tamper-evident closure of claim 20 wherein each section of said ridge includes an inclined upper surface.

22. The tamper-evident closure of claim 21 wherein said locking tabs are positioned axially between said frangible elements and said ridge.

23. The tamper-evident closure of claim 22 wherein said closure body is internally threaded.

24. The tamper-evident closure of claim 19 wherein said ridge is constructed and arranged as an annular member.

25. The tamper-evident closure of claim 24 wherein said ridge includes an inclined upper surface facing said plurality of locking tabs.

26. The tamper-evident closure of claim 25 wherein said locking tabs are positioned axially between said frangible elements and said ridge.

27. The tamper-evident closure of claim 26 wherein said closure body is internally threaded.

28. In combination:

a container having a neck portion defining a dispensing opening and an A diameter stop; and a tamper-evident closure for said container, said tamper-evident closure comprising:

a closure body; and a tamper-evident band connected to said closure body by a plurality of frangible elements, said tamper-evident band including a plurality of locking tabs constructed and arranged to abut against said A diameter stop during initial removal of said closure from said container, each locking tab being constructed and arranged with a radially-inward first portion having a free end and an intermediate second portion located between said first portion and the remainder of said tamper-evident band, said first portion being enlarged relative to said second portion and said second portion having a reduced axial thickness relative to said first portion, said tamper-evident band further including a radially inwardly extending ridge that is constructed and arranged to prevent repositioning of a plurality of said locking tabs to a substantially vertical orientation wherein said plurality of locking tabs avoid abutment with said A diameter stop.

29. The combination of claim 28 wherein said ridge is arranged into a plurality of spaced-apart sections.

30. The combination of claim 29 wherein each section of said ridge includes an inclined upper surface.

31. The combination of claim 30 wherein said locking tabs are positioned axially between said frangible elements and said ridge.

32. The combination of claim 31 wherein said closure body is internally threaded.

33. The combination of claim 28 wherein said ridge is constructed and arranged as an annular member.

34. The combination of claim 33 wherein said ridge includes an inclined upper surface facing said plurality of locking tabs.

35. The combination of claim 34 wherein said locking tabs are positioned axially between said frangible elements and said ridge.

36. The combination of claim 35 wherein said closure body is internally threaded.

* * * * *